US007440704B2

(12) United States Patent
Kobayashi

(10) Patent No.: US 7,440,704 B2
(45) Date of Patent: Oct. 21, 2008

(54) IMAGE FORMING APPARATUS

(75) Inventor: Yasushi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 229 days.

(21) Appl. No.: 11/220,322

(22) Filed: Sep. 6, 2005

(65) Prior Publication Data

US 2006/0051108 A1 Mar. 9, 2006

(30) Foreign Application Priority Data

Sep. 9, 2004 (JP) ..... 2004-261865

(51) Int. Cl.
*G03G 15/00* (2006.01)

(52) U.S. Cl. ..... 399/12; 399/24; 399/25

(58) Field of Classification Search ..... 399/9, 399/12, 13, 24, 25; 347/19, 49, 86
See application file for complete search history.

(56) References Cited

U.S. PATENT DOCUMENTS 7,233,747 B2 * 6/2007 Tomitaka ..... 399/12
7,242,873 B2 * 7/2007 Saisu et al. ..... 399/12
7,263,298 B2 * 8/2007 Nagamine et al. ..... 399/12

FOREIGN PATENT DOCUMENTS

JP 2002-029042 A 1/2002

* cited by examiner

*Primary Examiner*—Hoan H Tran
(74) *Attorney, Agent, or Firm*—Panitch Schwarze Belisario & Nadel LLP

(57) ABSTRACT

A cartridge information managing unit reads a kind of toner cartridge which is detachable to an image forming apparatus main body and ID information stored in a toner cartridge identification information storing unit and manages them. A process switching unit of an image forming unit switches a processing method of received image information on the basis of the read ID information of the toner cartridge. Even if the toner cartridge is incompatible with the apparatus, deterioration in image quality is suppressed.

9 Claims, 9 Drawing Sheets

IMAGE FORMING APPARATUS

BACKGROUND OF THE INVENTION

1. Field of the Invention

The invention relates to an image forming apparatus and, more particularly, to an image forming apparatus to which a unit is detachable.

2. Related Background Art

In an image forming apparatus such as electrophotographic printer, ink jet printer, or the like, a vessel, that is, what is called a cartridge in which a developing agent, ink, or the like is contained and which is detachable to the image forming apparatus main body and enables arbitrary supply or exchange is used. In recent years, many cartridges which cope with various applications have been used in order to meet a variety of requirements for realization of high quality and high precision of an image which is outputted, a high processing speed, and the like. External shapes of those cartridges have been designed in common so that they can be used in common for a number of variety of apparatuses. Discrimination of a kind of cartridge is electrically or mechanically made.

As an example of the electrical discriminating methods, identification information (also referred to as ID information hereinbelow) is stored in the cartridge, the image forming apparatus side reads out the ID information from the attached cartridge, thereby discriminating the kind of cartridge, and an image is formed under conditions according to the kind (for example, refer to JP-A-2002-29042). For this purpose, a plurality of kinds of cartridge information in each of which the ID information of the cartridge and the image forming conditions corresponding thereto are used as a set have previously been registered in the image forming apparatus.

However, since proper image forming conditions cannot be set as for the cartridge of the kind which is not previously registered, it is determined that such a cartridge is incompatible with the image forming apparatus. Thus, such a problem to be solved that the kind of cartridge which is compatible with the image forming apparatus is limited remains.

SUMMARY OF THE INVENTION

It is an object of the invention to provide an image forming apparatus to which a unit is detachable.

According to the present invention, there is provided an image forming apparatus comprising:

a unit which is detachable to an apparatus main body;

a unit information managing unit which obtains identification information of the unit and manages it; and an image forming section which forms an image on the basis of a predetermined image forming parameter, wherein the image forming section has process selector which selects a processing method of received image information on the basis of the obtained identification information of the unit.

In the image forming apparatus, the unit information managing unit comprises an identification information obtaining section which obtains the identification information of the unit; an identification information discrimination section which discriminates whether a result obtained by the identification information obtaining section indicates that the obtained identification information coincides or does not coincide with registration unit information which has previously been registered; and a discrimination result memory which holds a discrimination result by the unit identification information discrimination section.

Moreover, the image forming apparatus may further comprise a correction coefficient generator which corrects the image forming parameter when the identification information of the unit does not coincide with the registration unit information.

Moreover, in the image forming apparatus, the correction coefficient generator may comprise a pattern generator which generates a predetermined reading pattern; a sensor which reads the reading pattern generated by the pattern generator means; and a correction coefficient calculating section which calculates a correction coefficient of the image forming parameter on the basis of a reading result of the sensor.

Moreover, in the image forming apparatus, when the identification information of the unit coincides with the registration unit information, the image forming section may form the image on the basis of the registration unit information.

Moreover, in the image forming apparatus, when the identification information of the unit does not coincide with the registration unit information, a halftone screen which is applied to the image creation may be changed to form the image. In this case, the change of the halftone screen may be a change to a screen in which the number of lines is small.

Moreover, in the image forming apparatus, when the identification information of the unit does not coincide with the registration unit information, the kind of developing agent which is used may be limited to form the image. In this case, the kinds of the developing agents that are used may be limited to a black developing agent.

According to the invention, even if the toner cartridge (unit) attached to the apparatus main body is incompatible with the image forming apparatus, since the image forming operation is executed by using corrected image forming parameters, such an effect that deterioration in image quality can be suppressed is obtained.

The above and other objects and features of the present invention will become apparent from the following detailed description and the appended claims with reference to the accompanying drawings.

DETAILED DESCRIPTION OF THE PREFERRED EMBODIMENTS

Identification information obtaining section which reads identification information of a unit, process selector which switches a processing method of received image information on the basis of a reading result of the identification information obtaining section, and correction coefficient calculating section which, when the reading result "does not coincide" with registration unit information which has previously been registered, forms a reading pattern and calculates a correction coefficient of an image forming parameter on the basis of the reading result are realized by control section of a CPU (central processing unit) which is constructed by a method whereby the CPU provided for an apparatus main body executes a predetermined program which has previously been stored in a ROM (read only memory) of the apparatus main body.

Embodiment 1

Figure 1:
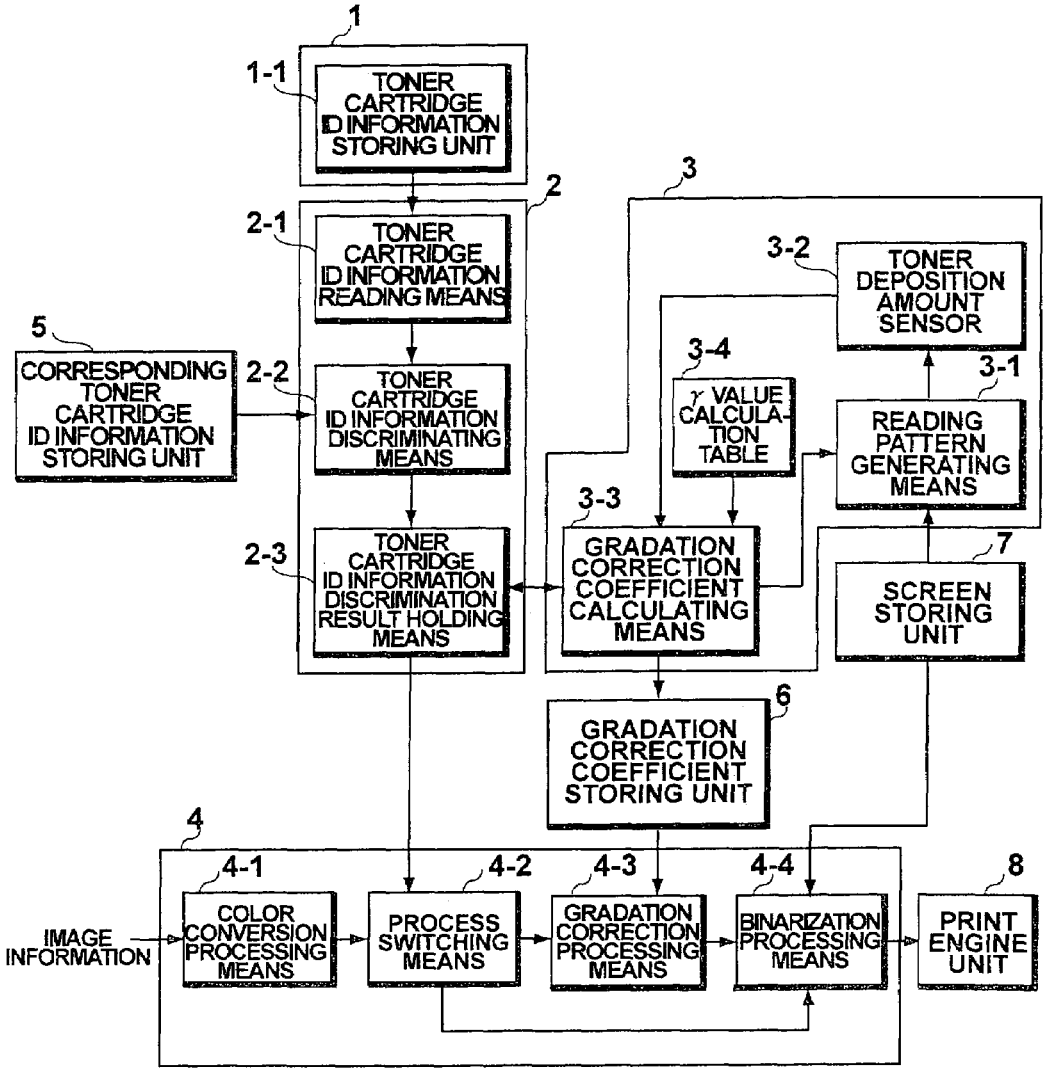
FIG. 1 is a block diagram of a construction of an image forming apparatus according to the embodiment 1.

FIG. 1 is a block diagram of a construction of an image forming apparatus according to the embodiment 1.

As shown in the diagram, the image forming apparatus according to the embodiment 1 has: a toner cartridge 1; a cartridge information managing unit 2; a correction coefficient generator 3; an image forming unit 4; a corresponding toner cartridge identification information storing unit 5; a gradation correction coefficient storing unit 6; a screen storing unit 7; and a print engine unit 8.

The toner cartridge 1 is a vessel, that is, what is called a cartridge which has toner corresponding to each color, enables the toner to be arbitrarily supplied, and is detachable to the image forming apparatus main body. In recent years, many cartridges which cope with various applications have been used in order to meet a variety of requirements for realization of high quality and high precision of an image which is outputted, a high processing speed, and the like. External shapes of those cartridges have been designed in common so that they can be used in common for a number of variety of apparatuses. A toner cartridge identification information storing unit 1-1 is provided to electrically or mechanically make discrimination of the kind of cartridge.

The toner cartridge identification information storing unit 1-1 is an identification marker for a CPU (central processing unit) (not shown) of the apparatus main body to automatically specify the kind of cartridge when the toner cartridge 1 is attached to the apparatus main body. Ordinarily, the storing unit 1-1 is a portion where, for example, a magnetic line is deposited on the surface of the toner cartridge 1 or a simple shape change similar to such a line is formed thereon.

The cartridge information managing unit 2 has: ID information obtaining section 2-1 (from toner cartridge); ID information discrimination section 2-1 (of toner cartridge); and memory 2-3 for discrimination result. The managing unit 2 is a portion where the kind of toner cartridge 1 attached to the apparatus main body is specified and its specifying result is held and sent to the correction coefficient generator 3 and the image forming unit 4 as necessary.

The ID information obtaining section 2-1 (from toner cartridge) is means for detecting the identification (ID) information from the magnetic line deposited on the surface of the toner cartridge 1 or the simple shape change similar to such a line by a sensor (not shown). Ordinarily, a magnetic sensor for reading the magnetic line, converting it into an electric signal, and outputting it, an electric switch for reading the simple shape change by on/off of a contact switch, converting it into an electric signal, and outputting it, or the like is used.

The ID information discrimination section 2-1 (of toner cartridge) is means for discriminating whether the ID information detected by the ID information obtaining section 2-1 (from toner cartridge) "coincides" or "does not coincide" with ID information (registration identification information) of a registration unit which has previously been registered in the corresponding toner cartridge identification information storing unit 5. This means is control section of the CPU (not shown) constructed by a method whereby the CPU executes a predetermined program which has previously been stored in the ROM (read only memory) of the apparatus main body (not shown).

The memory 2-3 for discrimination result is means for holding a discrimination result determined by the ID information discrimination section 2-1 (of toner cartridge), that is, the discrimination result indicative of either "coincides" or "does not coincide" with registration unit information. This means is control section of the CPU (not shown) constructed by the method whereby the CPU executes the predetermined program which has previously been stored in the ROM of the apparatus main body (not shown).

The correction coefficient generator 3 has pattern generator 3-1, a toner deposition amount sensor 3-2, gradation correction coefficient calculating section 3-3, and a γ value calculation table 3-4. The correction coefficient generator 3 is a portion constructed in such a manner that, when the ID information discrimination section 2-1 (of toner cartridge) determines that the ID information "does not coincide" and the memory 2-3 for discrimination result holds the discrimination result, the correction coefficient generator 3 forms a correction coefficient to correct the image forming parameter and stores it into the gradation correction coefficient storing unit 6.

The pattern generator 3-1 is means for extracting a halftone screen from the screen storing unit 7 and directly printing the reading pattern (test pattern) onto a conveying belt (not shown). The halftone screen denotes a dither matrix used for the image forming apparatus to realize an area gradation. The halftone screen generates a halftone dot pattern by the well-known dithering process. In the embodiment, it is assumed that the dot pattern has an area ratio of, for example, 50%. The pattern generator 3-1 is control section of the CPU (not shown) constructed by the method whereby the CPU executes the predetermined program which has previously been stored in the ROM of the apparatus main body (not shown), activates the image forming unit 4 and the print engine unit 8, and allows the reading pattern to be directly printed onto the conveying belt (not shown) by an ordinary printing step.

The toner deposition amount sensor 3-2 is a optical density reading sensor for reading a optical density value of the reading pattern directly formed on the conveying belt and sending the optical density value as a reading signal to the gradation correction coefficient calculating section 3-3. Ordinarily, a reflectance measuring sensor for irradiating a laser beam onto the reading pattern directly formed on the conveying belt and measuring its reflectance is used.

The gradation correction coefficient calculating section 3-3 is means for receiving the reading signal from the toner deposition amount sensor 3-2 and calculating a gradation correction coefficient γ on the basis of the γ value calculation table 3-4. Contents of the calculation of the gradation correction coefficient γ will be described in detail hereinbelow with reference to the drawings.

Figure 2:
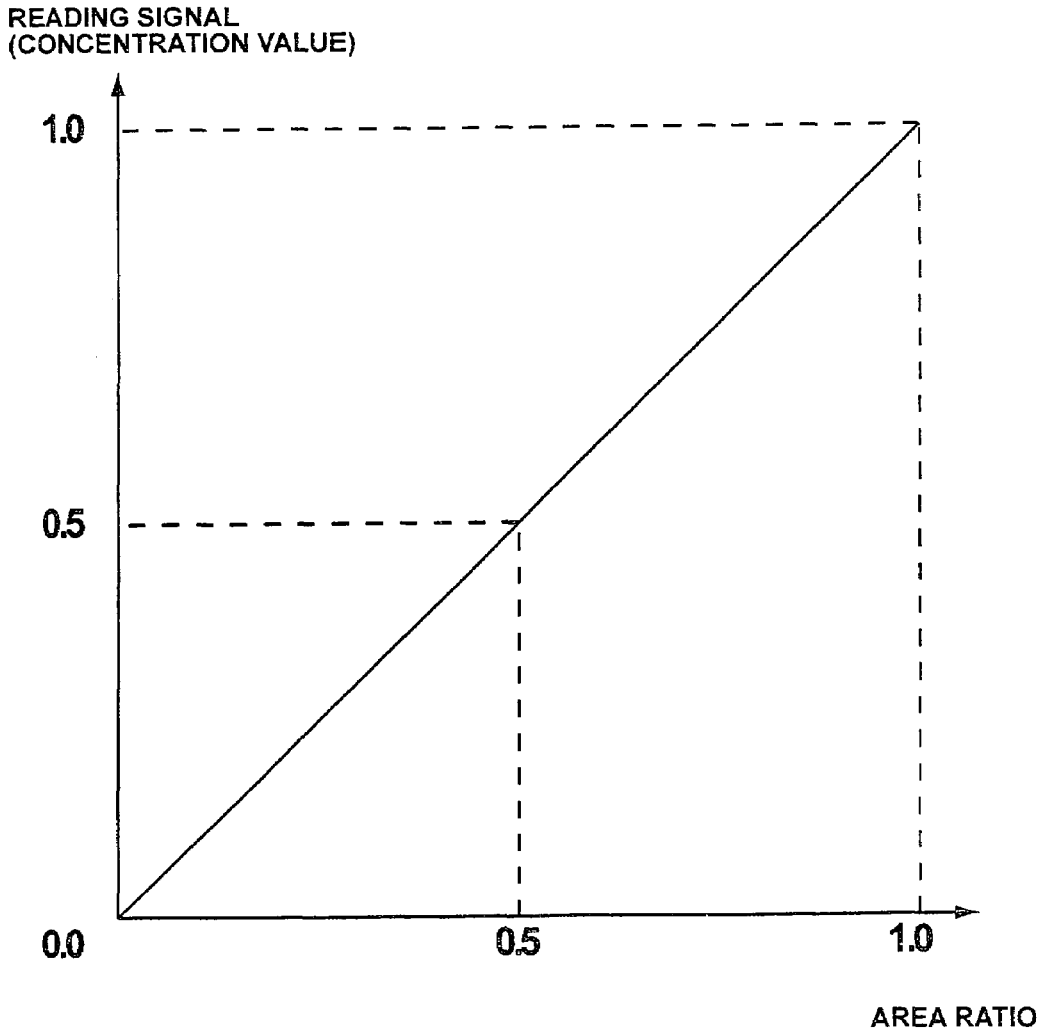
FIG. 2 is a characteristics diagram according to compatible toner.

FIG. 2 is a characteristics diagram according to the compatible toner.

This diagram shows a relation between the area ratio (axis of abscissa) and the optical density value (axis of ordinate) of the reading pattern directly formed on the conveying belt by using the toner that is compatible with the image forming apparatus according to the embodiment (what is called, an original manufacturer's product).

The area ratio=[(area of the surface covered with the toner)/(area of the pattern)]

The optical density value is expressed by a logarithm of the reflectance measured by the reflectance measuring sensor. As shown in the diagram, there is shown the state where if the toner compatible with the image forming apparatus according to the embodiment is used, when the area ratio=0 (the inherent state of the conveying belt), all of the irradiated laser beam is reflected (hereinafter, the optical density value to the area ratio=0 is assumed to be 0.0), when the area ratio=1.0 (the state where the whole pattern is covered with the toner), all of the irradiated laser beam is absorbed (hereinbelow, the optical density value to the area ratio=1.0 is assumed to be 1.0), and the characteristics between those two points are shown by a straight line. This state is obtained in the case where the image forming apparatus forms the best image.

Figure 3:
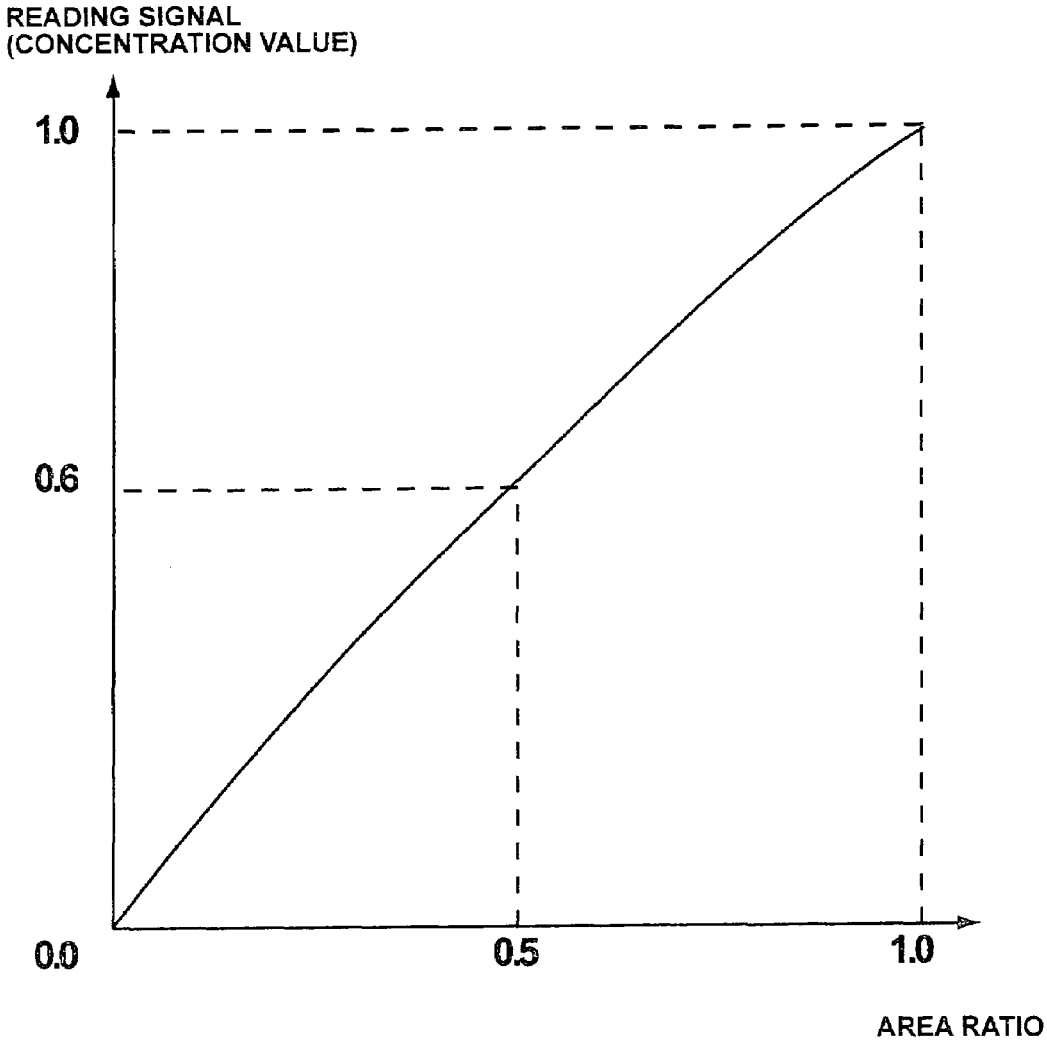
FIG. 3 is a characteristics diagram according to toner used actually.

FIG. 3 is a characteristics diagram according to the toner used actually.

This diagram is an example of a graph showing a relation between the area ratio (axis of abscissa) and the optical density value (axis of ordinate) of the reading pattern directly formed on the conveying belt by using the toner cartridge 1 (FIG. 1) actually attached to the apparatus in order to enable the correction coefficient generator 3 (FIG. 1) to form the correction coefficient when the memory 2-3 for discrimination result (FIG. 1) holds the reading result "does not coincide".

As shown in the diagram, all of the irradiated laser beam is reflected (the optical density value=0.0) when the area ratio=0, all of the irradiated laser beam is absorbed (the optical density value=1.0) when the area ratio=1.0, the characteristics between those two points are shown by a predetermined curve, and the optical density value when the area ratio=0.5 is equal to 0.6.

Figure 4:
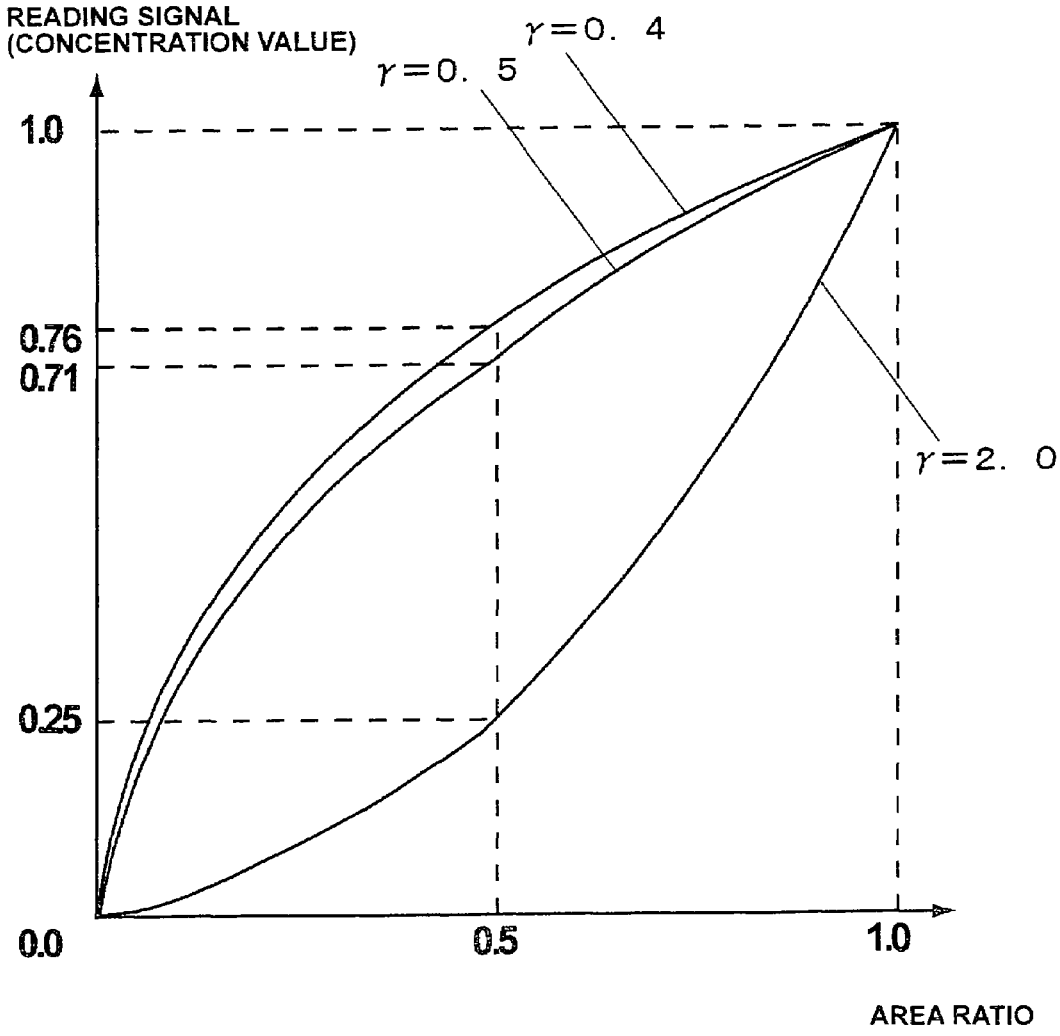
FIG. 4 is an explanatory diagram of a γ value calculation table.

FIG. 4 is an explanatory diagram of the γ value calculation table.

According to this diagram, when the relation between the optical density value and the area ratio is defined by the following expression The optical density value=(the γ-th power of the area ratio)

the relation between the area ratio and the optical density value is shown by a curve by using γ as a parameter. As shown in the diagram, when the area ratio is equal to 0.5, the optical density value is equal to 0.76 (γ=0.4); 0.71 (γ=0.5); and 0.25 (γ=2.0). In this manner, γ of the toner cartridge 1 (FIG. 1) actually attached to the apparatus can be obtained from the optical density value when the area ratio is equal to 0.5.

The explanation has been made here with respect to the example of only three points of γ=0.4, γ=0.5, and γ=2.0. By storing a number of γ values into the γ value calculation table, the γ value can be obtained by detecting the optical density value in the case where the area ratio of the reading pattern directly formed on the conveying belt by using the toner cartridge 1 (FIG. 1) actually attached to the apparatus is equal to 0.5. The obtained γ value is stored into the gradation correction coefficient storing unit 6. The γ value calculation table has previously been stored in the ROM (not shown) of the apparatus main body.

The gradation correction coefficient calculating section 3-3 described above is control section of the CPU (not shown) constructed by the method whereby the CPU executes the predetermined program which has previously been stored in the ROM (not shown) of the apparatus main body.

Returning to FIG. 1, the image forming unit 4 has color converter 4-1, process selector 4-2, gradation correction processing section 4-3, and binarization section 4-4. The image forming unit 4 is a portion for correcting gradation of image information received from an upper apparatus, converting it into print data, and sending the print data to the print engine unit 8.

The color converter 4-1 is means for converting the image information of R, G, and B received from the upper apparatus into image data of YMCK by the well-known method.

When the memory 2-3 for discrimination result holds the discrimination result "coincides", the process selector 4-2 sends the received image data to the binarization section 4-4 so that the image data is processed on the basis of registration unit information which has previously been stored in the corresponding toner cartridge identification information storing unit 5. When the memory 2-3 for discrimination result holds the discrimination result "does not coincide", the process selector 4-2 sends the received image data to the gradation correction processing section 4-3 so that the image data is gradation-corrected.

The gradation correction processing section 4-3 is means for receiving the γ value from the gradation correction coefficient storing unit 6 and making the gradation correction by multiplying the optical density value of the received image data by the (1/γ)th power. By this process, the relation between the area ratio of the print output and the reading signal optical density approaches the characteristics (FIG. 2) according to the compatible toner. The image data which was gradation-corrected as mentioned above is sent to the binarization section.

The binarization section 4-4 converts the received image data into a dot pattern by using the halftone screen stored in the screen storing unit 7 and sends the dot pattern as print data to the print engine unit 8. All of the color converter 4-1, process selector 4-2, gradation correction processing section 4-3, and binarization section 4-4 constructing the image forming unit 4 as described above are control section of the CPU (not shown) constructed by the method whereby the CPU executes the predetermined program which has previously been stored in the ROM of the apparatus main body (not shown).

The corresponding toner cartridge identification information storing unit 5 is a memory for preliminarily registering the identification information of the toner cartridge compatible with the image forming apparatus according to the embodiment and is a memory area provided in a predetermined storing unit (not shown) provided for the apparatus main body. In addition to the registration ID information, main image forming conditions of the cartridge or the like can be also stored in this area. The image forming unit 4 forms the image on the basis of the main image forming conditions.

The gradation correction coefficient storing unit 6 is a memory for storing the γ value formed by the gradation correction coefficient calculating section 3-3, and is a memory area provided in a predetermined storing unit (not shown) provided for the apparatus main body.

The screen storing unit 7 is a memory for storing the halftone screen which is used for the image forming unit 4 to execute the binarizing process of the image data. The screen storing unit 7 is a memory area provided in a predetermined storing unit (not shown) provided for the apparatus main body.

The print engine unit 8 is a portion for receiving the print data from the image forming unit 4 and print-outputting an image corresponding to the print data onto a print medium.

The operation of the embodiment 1 will now be described with reference to a flowchart.

Figure 5:
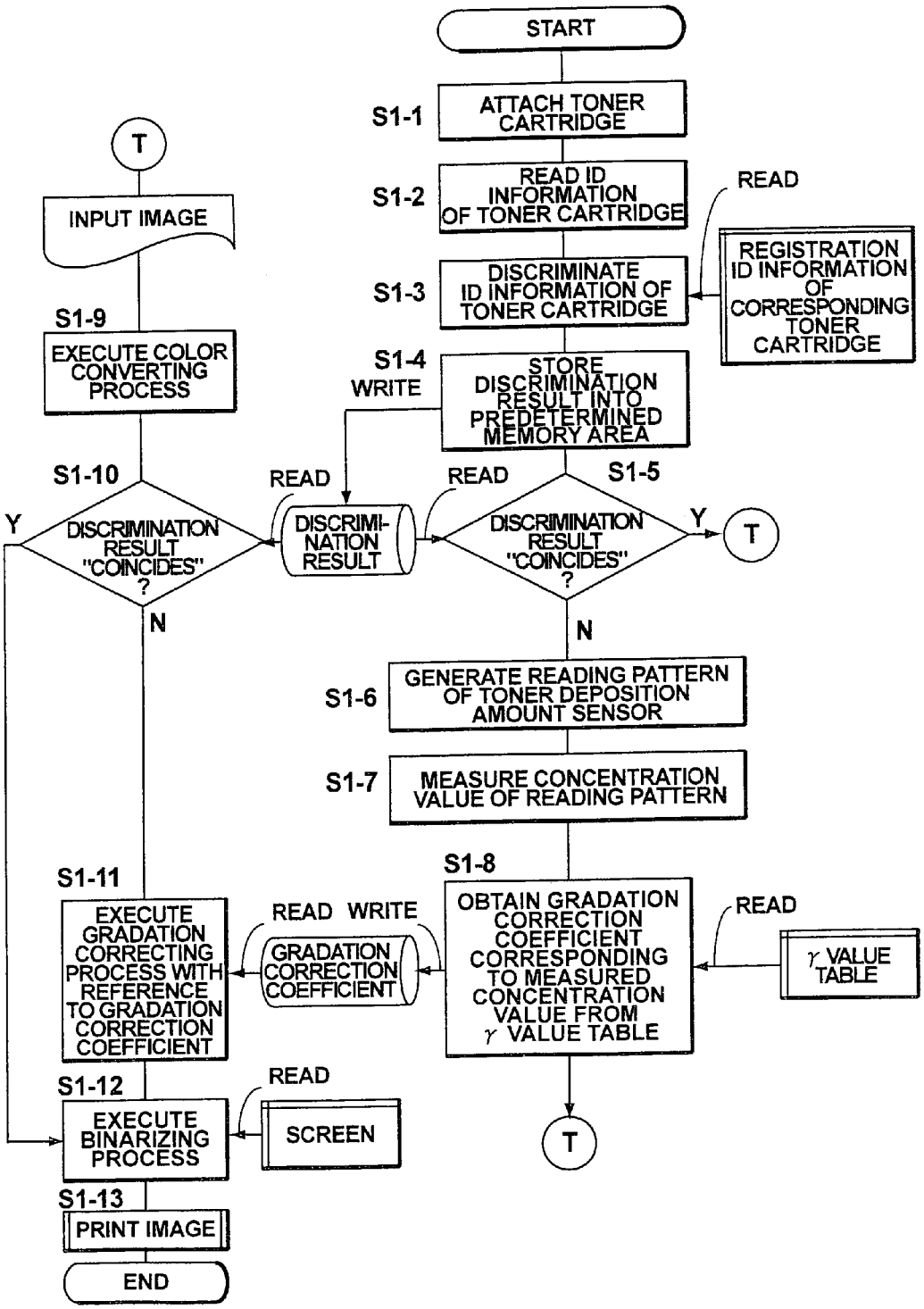
FIG. 5 is an operation flowchart of the image forming apparatus according to the embodiment 1.

FIG. 5 is an operation flowchart of the image forming apparatus according to the embodiment 1.

The operation of the image forming apparatus will be sequentially described in accordance with steps S1-1 to S1-13 in the flowchart.

Step S1-1

The operator attaches the toner cartridge 1 (FIG. 1) to the apparatus main body.

Step S1-2

The ID information obtaining section 2-1 (from toner cartridge) (FIG. 1) reads the identification information from the toner cartridge identification information storing unit 1-1 (FIG. 1).

Step S1-3

The ID information discrimination section 2-1 (of toner cartridge) (FIG. 1) discriminates either "coincides" or "does not coincide" by comparing the ID information read in step S1-2 with the registration ID information stored in the corresponding toner cartridge identification information storing unit 5 (FIG. 1).

Step S1-4

The ID information discrimination section 2-1 (of toner cartridge) (FIG. 1) holds the discrimination result about "coincides" or "does not coincide" into the memory 2-3 for discrimination result (FIG. 1).

Step S1-5

If the discrimination result held in the memory 2-3 for discrimination result (FIG. 1) indicates "coincides", the processing routine advances to step S1-9. If it indicates "does not coincide", step S1-6 follows.

Step S1-6

The pattern generator 3-1 (FIG. 1) extracts the halftone screen from the screen storing unit 7 (FIG. 1). The image forming unit 4 (FIG. 1) and the print engine unit 8 (FIG. 1) are controlled by an ordinary control method, thereby allowing the reading pattern to be directly printed onto the conveying belt (not shown).

Step S1-7

The toner deposition amount sensor 3-2 (FIG. 1) reads the optical density value of the reading pattern directly formed on the conveying belt and sends the optical density value as a reading signal to the gradation correction coefficient calculating section 3-3 (FIG. 1).

Step S1-8

The gradation correction coefficient calculating section 3-3 (FIG. 1) receives the reading signal from the toner deposition amount sensor 3-2 (FIG. 1), calculates the gradation correction coefficient $\gamma$ on the basis of the $\gamma$ value calculation table 3-4 (FIG. 1), and stores the calculated $\gamma$ value into the gradation correction coefficient storing unit 6 (FIG. 1).

Step S1-9

The color converter 4-1 (FIG. 1) converts the image information of R, G, and B received from the upper apparatus into the image data of YMCK.

Step S1-10

If the discrimination result held in the memory 2-3 for discrimination result (FIG. 1) indicates "coincides", the processing routine advances to step S1-12. If it indicates "does not coincide", the processing routine advances to step S1-11 (process selector 4-2 (FIG. 1)).

Step S1-11

The gradation correction processing section 4-3 (FIG. 1) receives the $\gamma$ value from the gradation correction coefficient storing unit 6 (FIG. 1) and multiplies the optical density value of the received image data by the $(1/\gamma)$th power, and sends the resultant value to the binarization section 4-4 (FIG. 1).

Step S1-12

The binarization section 4-4 (FIG. 1) obtains the halftone screen from the screen storing unit 7 (FIG. 1), converts the received image data into the dot pattern, and sends the dot pattern as print data to the print engine unit 8 (FIG. 1).

Step S1-13

The print engine unit 8 (FIG. 1) outputs the received print data onto the print medium and the processing routine is finished.

As described above, according to the embodiment, even if the toner cartridge attached to the image forming apparatus is not included in the toner cartridges of the kinds which have previously been registered in the image forming apparatus, the reading pattern is formed with the toner contained in the toner cartridge, the correction coefficient of the image forming parameter is calculated on the basis of the reading result, and the image creation is executed by the image forming parameter corrected by using the calculated correction coefficient. Therefore, such an effect that the deterioration in image quality can be suppressed is obtained.

Although the explanation has been made by limiting to the case where the toner cartridge attached to the image forming apparatus is not included in the toner cartridges of the kinds which have previously been registered in the image forming apparatus, the invention is not limited to such an example. That is, even if the toner cartridge is included in the toner cartridges of the kinds which have previously been registered in the image forming apparatus or even if the ID information cannot be read by the toner cartridge ID information obtaining section due to informalities of the ID information, processes similar to those in the case where the toner cartridge is not included in the toner cartridges of the kinds which have previously been registered in the image forming apparatus are executed. Therefore, such an effect that the deterioration in image quality can be suppressed is obtained.

Embodiment 2

In the case where the color cannot be accurately reproduced by using the halftone screen which is at present being used when the toner contained in the attached toner cartridge is used, it is an object of the embodiment to obtain an output image having high color reproducibility by changing the halftone screen even if, for example, resolution is slightly sacrificed.

Figure 6:
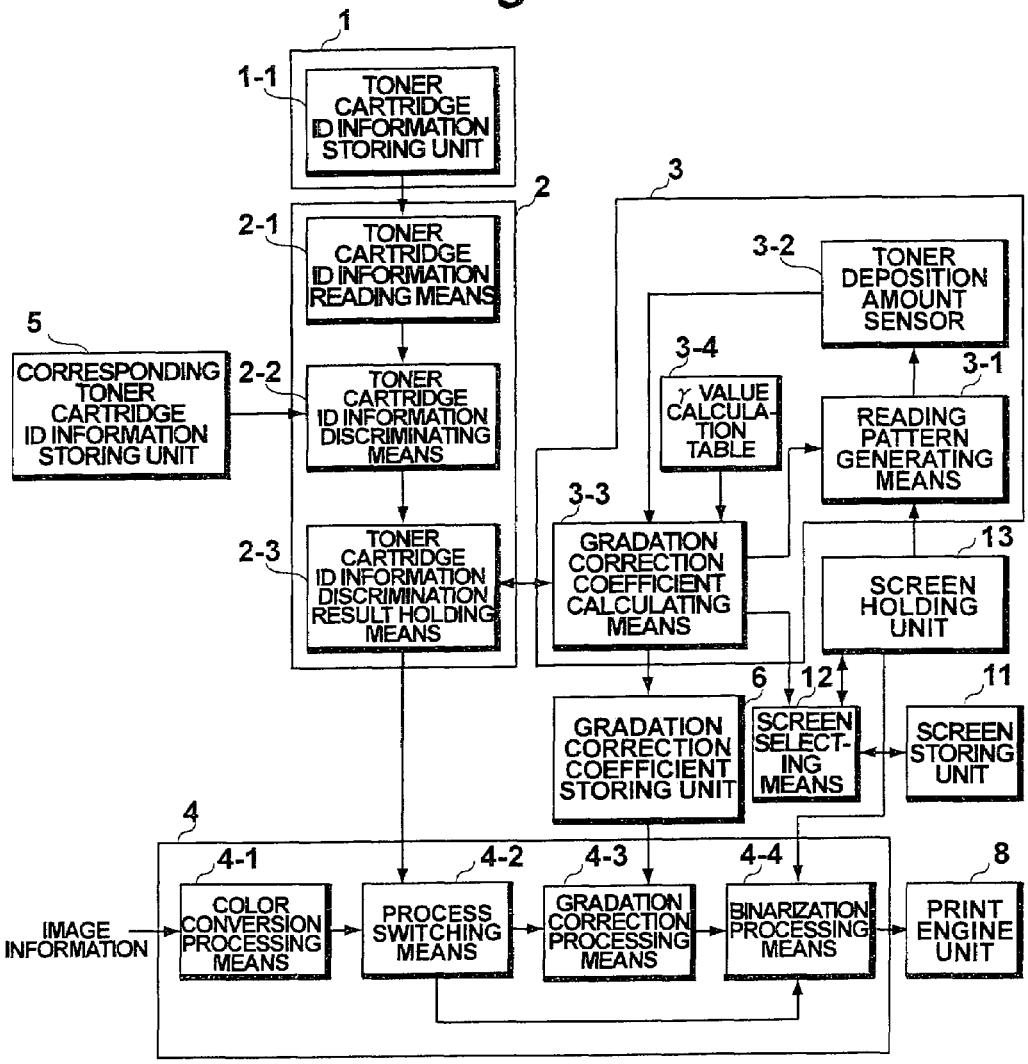
FIG. 6 is a block diagram of a construction of an image forming apparatus according to the embodiment 2.

FIG. 6 is a block diagram of a construction of an image forming apparatus according to the embodiment 2.

As shown in the diagram, the image forming apparatus according to the embodiment 2 has: the toner cartridge 1; the cartridge information managing unit 2; the correction coefficient generator 3; the image forming unit 4; the corresponding toner cartridge identification information storing unit 5; the gradation correction coefficient storing unit 6; the print engine unit 8; a screen storing unit 11; screen selector 12; and a screen holding unit 13.

Only portions different from those in the embodiment 1 will be described. Portions similar to those in the embodiment 1 will be designated by the same reference numerals and their description is omitted here.

The screen storing unit 11 is a memory for storing a plurality of kinds of halftone screens which are used in a binarizing process of the image data by the image forming unit 4.

The screen storing unit 11 is a memory area provided in a predetermined storing unit (not shown) provided for the apparatus main body.

The screen selector 12 is means for selecting an optimum one of the plurality of kinds of halftone screens stored in the screen storing unit 11. This means is control section of the CPU (not shown) constructed by a method whereby the CPU executes a predetermined program which has previously been stored in the ROM of the apparatus main body (not shown).

The screen holding unit 13 is a memory for holding the halftone screen selected by the screen selector 12 in order to send it to the pattern generator 3-1 and the binarization section 4-4 as necessary. The screen holding unit 13 is a memory area provided in a predetermined storing unit (not shown) provided for the apparatus main body. Since other component portions are similar to those in the embodiment 1, their description is omitted here.

The operation of the embodiment 2 will now be described with reference to a flowchart.

Figure 7:
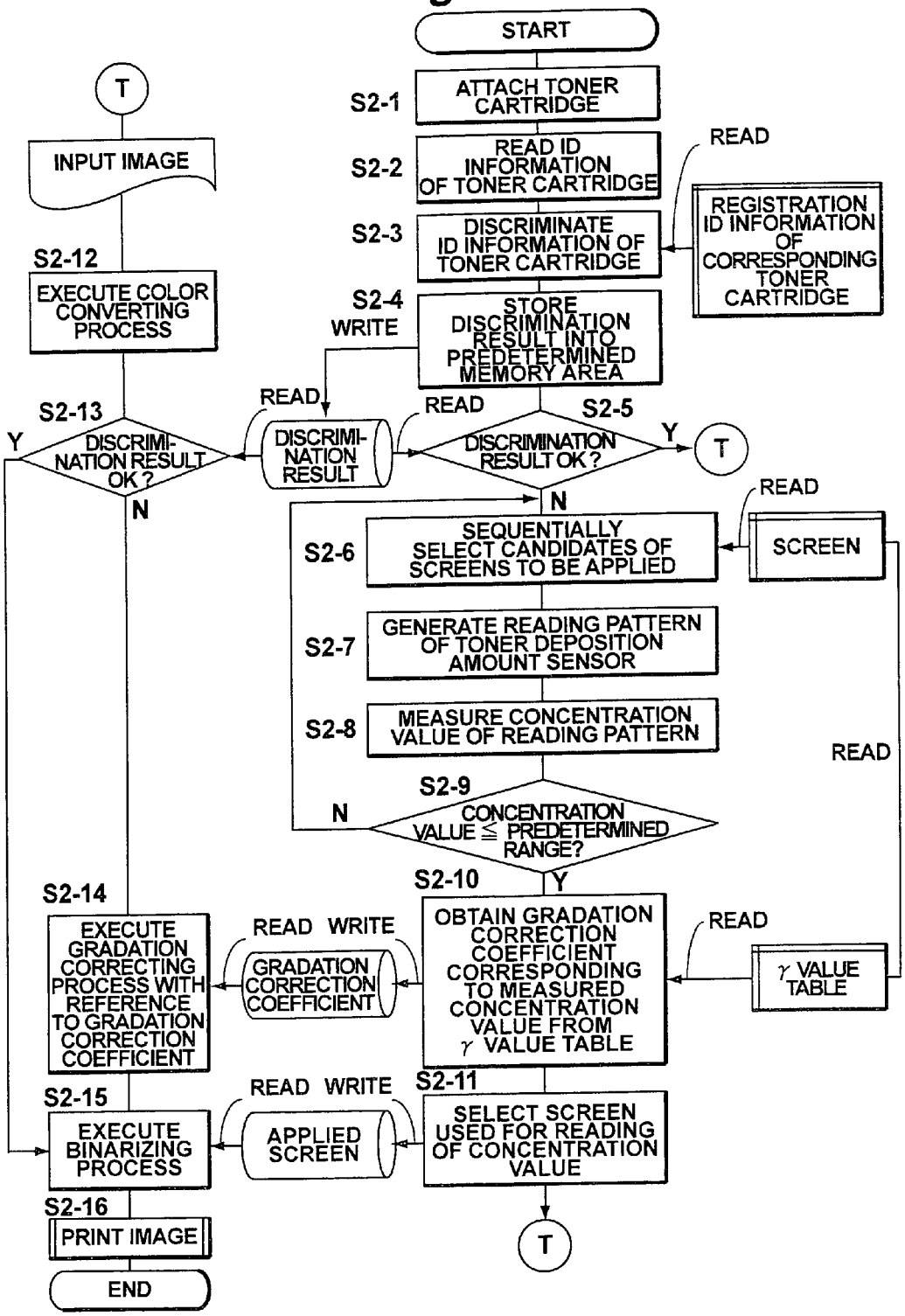
FIG. 7 is an operation flowchart of the image forming apparatus according to the embodiment 2.

FIG. 7 is an operation flowchart of the image forming apparatus according to the embodiment 2.

The operation of the image forming apparatus will be sequentially described in accordance with steps S2-1 to S2-16 in the flowchart.

Step S2-1

The operator attaches the toner cartridge 1 (FIG. 6) to the apparatus main body.

Step S2-2

The ID information obtaining section 2-1 (from toner cartridge) (FIG. 6) reads the identification information from the toner cartridge identification information storing unit 1-1 (FIG. 6).

Step S2-3

The ID information discrimination section 2-1 (of toner cartridge) (FIG. 6) discriminates either "coincides" or "does not coincide" by comparing the ID information read in step S2-2 with the registration ID information stored in the corresponding toner cartridge identification information storing unit 5 (FIG. 6).

Step S2-4

The ID information discrimination section 2-1 (of toner cartridge) (FIG. 6) holds the discrimination result about "coincides" or "does not coincide" into the memory 2-3 for discrimination result (FIG. 6).

Step S2-5

If the discrimination result held in the memory 2-3 for discrimination result (FIG. 6) indicates "coincides", step S2-12 follows. If it indicates "does not coincide", step S2-6 follows.

Step S2-6

The screen selector 12 (FIG. 6) sequentially extracts the plurality of kinds of halftone screens stored in the screen storing unit 11 (FIG. 6) and holds them as candidates for the screen into the screen holding unit 13 (FIG. 6).

Step S2-7

The pattern generator 3-1 (FIG. 6) extracts the screen candidates from the screen storing unit 13 (FIG. 6). The image forming unit 4 (FIG. 6) and the print engine unit 8 (FIG. 6) are controlled by the ordinary control method, thereby allowing the reading pattern to be directly printed onto the conveying belt (not shown).

Step S2-8

The toner deposition amount sensor 3-2 (FIG. 6) reads the optical density value of the reading pattern directly formed on the conveying belt and sends the optical density value as a reading signal to the gradation correction coefficient calculating section 3-3 (FIG. 6).

Step S2-9

The screen selector 12 (FIG. 6) discriminates whether or not the optical density value lies within a predetermined range. If the optical density value is out of the predetermined range, the processing routine is returned to step S2-6 and steps S2-6 to S2-9 are repeated. If it lies within the predetermined range, step S2-10 follows. The predetermined range used here is a preset range such as a range where the optical density value is equal to a value in a range (FIG. 4) from 0.71 to 0.25 when the area ratio=0.5, or the like.

Step S2-10

The gradation correction coefficient calculating section 3-3 (FIG. 6) receives the reading signal from the toner deposition amount sensor 3-2 (FIG. 6), calculates the gradation correction coefficient $\gamma$ on the basis of the $\gamma$ value calculation table 3-4 (FIG. 6), and stores the calculated $\gamma$ value into the gradation correction coefficient storing unit 6 (FIG. 6).

Step S2-11

The screen selector 12 (FIG. 6) selects the screen candidates as compatible halftone screens and holds them into the screen holding unit 13 (FIG. 6).

Step S2-12

The color converter 4-1 (FIG. 6) converts the image information of R, G, and B received from the upper apparatus into the image data of YMCK.

Step S2-13

If the discrimination result held in the memory 2-3 for discrimination result (FIG. 6) indicates "coincides", the processing routine advances to step S2-15. If it indicates "does not coincide", the processing routine advances to step S2-14 (process selector 4-2 (FIG. 6)).

Step S2-14

The gradation correction processing section 4-3 (FIG. 6) receives the $\gamma$ value from the gradation correction coefficient storing unit 6 (FIG. 6) and multiplies the optical density value of the received image data by the $(1/\gamma)$th power, and sends the resultant value to the binarization section 4-4 (FIG. 6).

Step S2-15

The binarization section 4-4 (FIG. 6) obtains the halftone screen from the screen holding unit 13 (FIG. 6), converts the received image data into the dot pattern, and sends the dot pattern as print data to the print engine unit 8.

Step S2-16

The print engine unit 8 (FIG. 6) outputs the received print data onto the print medium and the processing routine is finished.

As described above, according to the embodiment, in addition to the effect of the embodiment 1, even if the optimum color reproduction cannot be accomplished by using the halftone screen which is at present being used in the case of the toner contained in the attached toner cartridge, by keeping a plurality of kinds of halftone screens and selecting the screen having high color reproducibility among them, such an effect that the output image having the high color reproducibility can be obtained, for example, although the resolution is slightly sacrificed.

Embodiment 3

It is an object of the embodiment 3 to obtain minimum necessary information by gray-scale printing even if the operator attaches the toner cartridge incompatible with the image forming apparatus and the ordinary color printing cannot be executed.

Figure 8:
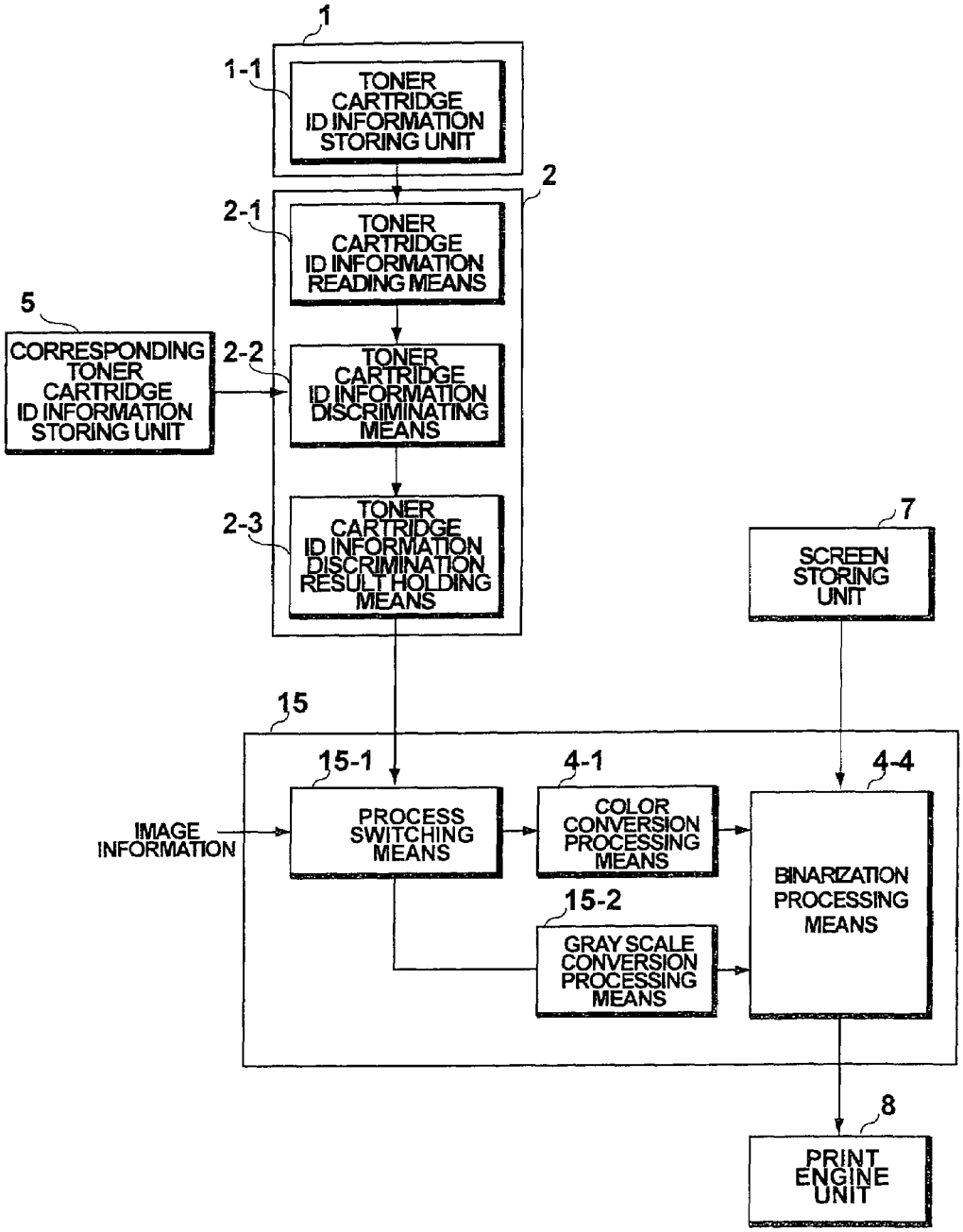
FIG. 8 is a block diagram of a construction of an image forming apparatus according to the embodiment 3.

FIG. 8 is a block diagram of a construction of an image forming apparatus according to the embodiment 3.

As shown in the diagram, the image forming apparatus according to the embodiment 3 has: the toner cartridge 1; the cartridge information managing unit 2; the corresponding toner cartridge identification information storing unit 5; the screen storing unit 7; the print engine unit 8; and an image forming unit 15. Only portions different from those in the embodiment 1 will be described. Portions similar to those in the embodiment 1 will be designated by the same reference numerals and their description is omitted here.

The image forming unit 15 has: the color converter 4-1; the binarization section 4-4; process selector 15-1; and gray scale converter 15-2. The image forming unit 15 is a portion for color converting or gray scale converting the image information received from the upper apparatus into the print data and sending it to the print engine unit 8.

The process selector 15-1 receives the image information from the upper apparatus and sending it to the color converter 4-1 in order to allow the ordinary processes to be executed when the memory 2-3 for discrimination result holds "coincides". When the memory 2-3 for discrimination result holds "does not coincide", the process selector 15-1 sends the received image information to the gray scale converter 15-2 in order to allow the image information to be gray scale converted. This means is control section of the CPU (not shown) constructed by a method whereby the CPU executes a predetermined program which has previously been stored in the ROM (read only memory) of the apparatus main body (not shown). Since other component portions are similar to those in the embodiment 1, their description is omitted here.

The gray scale converter 15-2 is means for converting the received image information into gray scale image information. The gray scale image information is image information expressed only by brightness. This means is control section of the CPU (not shown) constructed by a method whereby the CPU executes a predetermined program which has previously been stored in the ROM (read only memory) of the apparatus main body (not shown).

The operation of the embodiment 3 will now be described with reference to a flowchart.

Figure 9:
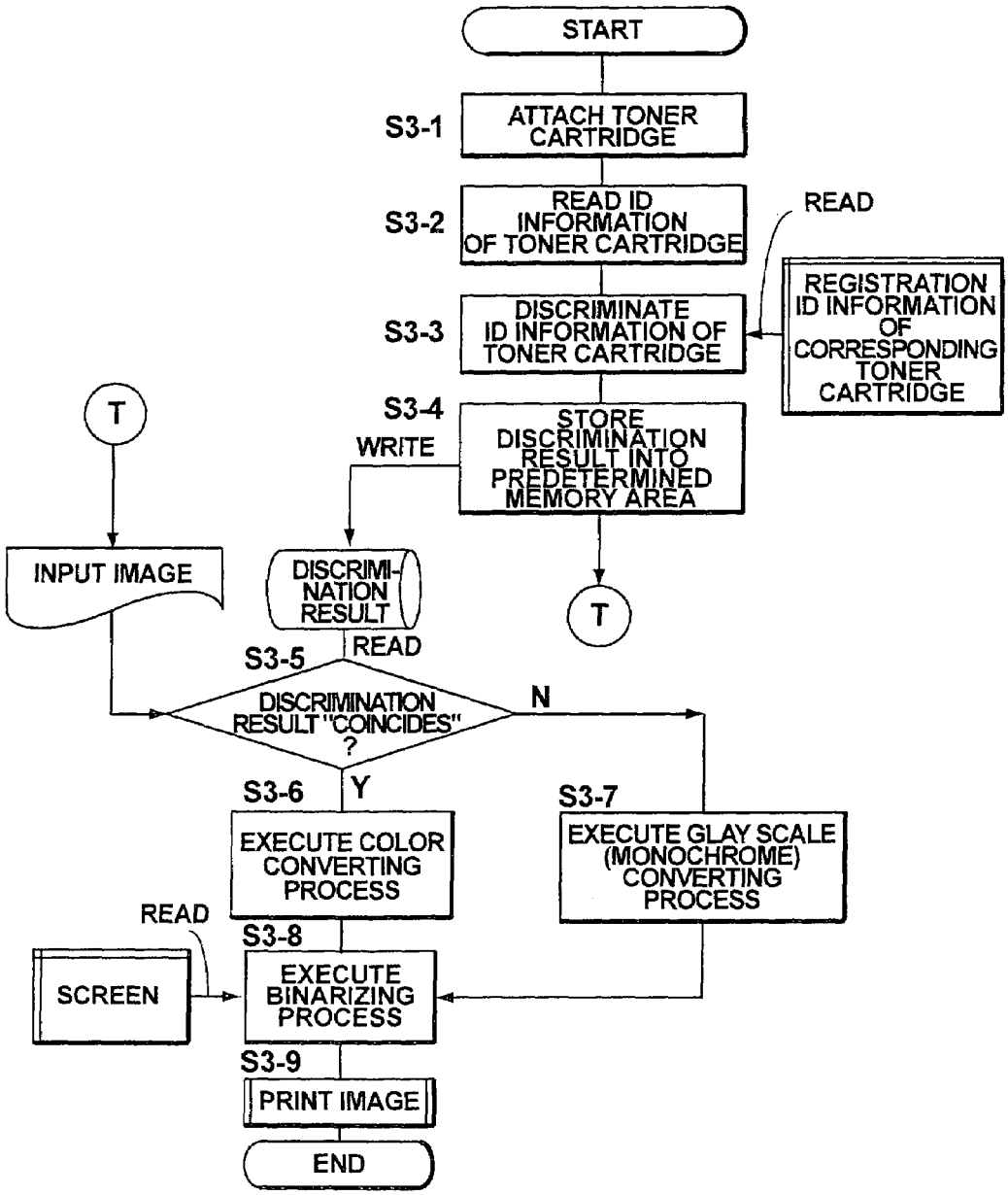
FIG. 9 is an operation flowchart of the image forming apparatus according to the embodiment 3.

FIG. 9 is an operation flowchart of the image forming apparatus according to the embodiment 3.

The operation of the image forming apparatus will be sequentially described in accordance with steps S3-1 to S3-9 in the flowchart.

Step S3-1

The operator attaches the toner cartridge 1 (FIG. 8) to the apparatus main body.

Step S3-2

The ID information obtaining section 2-1 (from toner cartridge) (FIG. 8) reads the identification information from the toner cartridge identification information storing unit 1-1 (FIG. 8).

Step S3-3

The ID information discrimination section 2-1 (of toner cartridge) (FIG. 8) discriminates either "coincides" or "does not coincide" by comparing the ID information read in step S3-2 with the registration ID information stored in the corresponding toner cartridge identification information storing unit 5 (FIG. 8).

Step S3-4

The ID information discrimination section 2-1 (of toner cartridge) (FIG. 8) holds the discrimination result about "coincides" or "does not coincide" into the memory 2-3 for discrimination result (FIG. 8).

Step S3-5

When the process selector 15-1 (FIG. 8) receives the image information from the upper apparatus, the processing routine advances to step S3-6 if the discrimination result held in the memory 2-3 for discrimination result (FIG. 8) indicates "coincides". If it indicates "does not coincide", step S3-7 follows.

Step S3-6

The color converter 4-1 (FIG. 8) converts the image information of R, G, and B received from the upper apparatus into the image data of YMCK by the ordinary processes.

Step S3-7

The gray scale converter 15-2 (FIG. 8) converts the image information of R, G, and B received from the upper apparatus into gray scale image information.

Step S3-8

The binarization section 4-4 (FIG. 8) obtains the halftone screen from the screen storing unit 7 (FIG. 8), converts the received image data into the dot pattern, and sends the dot pattern as print data to the print engine unit 8.

Step S3-9

The print engine unit 8 (FIG. 8) outputs the received print data onto the print medium and the processing routine is finished.

As described above, according to the embodiment, even if the attached toner cartridge is incompatible with the image forming apparatus, since the image data is forcedly outputted as gray scale data, a load on the image forming apparatus due to the incompatible toner can be suppressed to the minimum limit. There is obtained such an effect that the minimum necessary information can be obtained by the gray-scale printing even if the operator attaches the toner cartridge incompatible with the image forming apparatus and the ordinary color printing cannot be executed.

Although all of the above embodiments have been described on the assumption that the CPU (not shown) construct each of the foregoing means (section) by the control section of the CPU constructed by the method whereby the CPU executes a predetermined program which has previously been stored in the ROM of the apparatus main body (not shown). However, the invention is not limited to such an example. In other words, all or a part of the above means (section) can be also constructed by dedicated electronic circuits.

Although the invention has been described above by limiting to the case where it is applied to the color electrophotographic printer, the invention is not limited to such an example. For instance, any apparatus can use the invention so long as it is an image forming apparatus having a detachable unit, such as ink jet printer, copying apparatus, or the like. The unit is not limited to the toner cartridge either but the invention can be also used so long as it is a unit which becomes a cause of fluctuation in print quality.

The present invention is not limited to the foregoing embodiments but many modifications and variations are possible within the spirit and scope of the appended claims of the invention.

What is claimed is:

1. An image forming apparatus comprising:

a unit which is detachable to an apparatus main body;

a unit information managing unit which obtains identification information of said unit and manages it; and an image forming section which forms an image on the basis of a predetermined image forming parameter, wherein said image forming section has process selector which selects a processing method of received image information on the basis of the obtained identification information of said unit, wherein said unit information managing unit comprises:

identification information obtaining section which obtains the identification information of said unit;

identification information discrimination section which discriminates whether a result obtained by said identification information obtaining section indicates that the obtained identification information coincides or does not coincide with registration unit information which has previously been registered; and discrimination result memory which holds a discrimination result by said unit identification information discrimination section.

2. The image forming apparatus according to claim 1, further comprising a correction coefficient generator which corrects said image forming parameter when the identification information of said unit does not coincide with said registration unit information.

3. The image forming apparatus according to claim 2, wherein said correction coefficient generator comprises:

pattern generator which generates a predetermined reading pattern;

a sensor which reads the reading pattern generated by said pattern generator means; and correction coefficient calculating section which calculates a correction coefficient of said image forming parameter on the basis of a reading result of said sensor.

4. The image forming apparatus according to claim 1, wherein when the identification information of said unit coincides with said registration unit information, said image forming section forms said image on the basis of said registration unit information.

5. The image forming apparatus according to claim 1, wherein when the identification information of said unit does not coincide with said registration unit information, a halftone screen which is applied to the image creation is changed to form the image.

6. The image forming apparatus according to claim 5, wherein the change of said halftone screen is a change to a screen in which the number of lines is small.

7. The image forming apparatus according to claim 1, wherein when the identification information of said unit does not coincide with said registration unit information, the kind of developing agent which is used is limited to form the image.

8. The apparatus according to claim 7, wherein the kind of said developing agent is a black developing agent.

9. An image forming apparatus comprising:

a unit which is detachable to an apparatus main body;

a unit information managing unit which obtains identification information of said unit and manages it; and an image forming section which forms an image on the basis of a predetermined image forming parameter, wherein said image forming section has a process selector which selects an image forming condition on the basis of the obtained identification information of said unit; and wherein said unit information managing unit comprises:

identification information obtaining section which obtains the identification information of said unit;

identification information discrimination section which discriminates whether a result obtained by said identification information obtaining section indicates that the obtained identification information coincides or does not coincide with registration unit information which has previously been registered; and discrimination result memory which holds a discrimination result by said unit identification information discrimination section.

* * * * *